US010495034B2

(12) United States Patent
Braun et al.

(10) Patent No.: US 10,495,034 B2
(45) Date of Patent: Dec. 3, 2019

(54) FEEDING ARRANGEMENT FOR INTRODUCING RECIRCULATED EXHAUST GAS

(71) Applicant: MTU Friedrichshafen GmbH, Friedrichshafen (DE)

(72) Inventors: Hermann Braun, Friedrichshafen (DE); Thomas Rode, Achberg (DE); Christian-Paul Stelzer, Tettnang (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 62 days.

(21) Appl. No.: 15/945,990

(22) Filed: Apr. 5, 2018

(65) Prior Publication Data

US 2018/0223776 A1 Aug. 9, 2018

Related U.S. Application Data

(63) Continuation of application No. PCT/EP2017/000295, filed on Mar. 6, 2017.

(30) Foreign Application Priority Data

Mar. 11, 2016 (DE) ..... 10 2016 003 003

(51) Int. Cl.

| | |
|---|---|
| ***F02D 9/08*** | (2006.01) |
| ***F02M 26/19*** | (2016.01) |
| *F02D 9/14* | (2006.01) |

(52) U.S. Cl.

CPC ..... *F02M 26/19* (2016.02); *F02D 9/08* (2013.01); *F02D 9/14* (2013.01)

(58) Field of Classification Search

CPC ..... F02M 26/19; F02M 26/50; F02M 26/74; F02D 9/08

(Continued)

(56) References Cited

U.S. PATENT DOCUMENTS 4,422,418 A 12/1983 Dorn
6,513,508 B2 * 2/2003 Fischer ..... F02M 35/10118 123/568.17

(Continued)

FOREIGN PATENT DOCUMENTS

CA 2 299 929 A1 9/2001
DE 198 42 842 A1 3/2000

(Continued)

OTHER PUBLICATIONS

International Search Report dated May 24, 2017 for International Application No. PCT/EP2017/000295 (6 pages).

*Primary Examiner* — Hai H Huynh
(74) *Attorney, Agent, or Firm* — Taylor IP, P.C.

(57) ABSTRACT

An internal combustion engine including a cylinder head, a fresh air duct configured for providing a fresh air supply to the internal combustion engine, and a quick-closing valve arranged in the fresh air duct, upstream of the cylinder head of the internal combustion engine, in order to interrupt the fresh air supply. The internal combustion engine also includes an exhaust gas recirculation pipe that has an outlet opening that is arranged centrally in the fresh air duct and, in a flow direction of the fresh air supply, upstream of the quick-closing valve forming a minimum gap between the outlet opening and the quick-closing valve.

6 Claims, 1 Drawing Sheet

(58) Field of Classification Search
USPC ..... 123/198 D, 568.17
See application file for complete search history.

(56) References Cited

U.S. PATENT DOCUMENTS

| | | | | |
|---|---|---|---|---|
| 6,886,544 | B1 * | 5/2005 | Bui | F02M 35/10118 123/568.17 |
| 7,281,530 | B2 * | 10/2007 | Usui | F02M 35/10222 123/568.11 |
| 7,353,811 | B2 * | 4/2008 | Weisz | F02D 9/18 123/568.17 |
| 7,389,770 | B2 * | 6/2008 | Bertilsson | F02M 35/10118 123/568.17 |
| 7,798,135 | B2 * | 9/2010 | Bischofberger | F02M 35/10118 123/568.11 |
| 8,899,214 | B2 * | 12/2014 | Guerry | F02M 29/06 123/568.17 |
| 8,915,235 | B2 | 12/2014 | Luft et al. | |
| 2007/0107708 | A1 | 5/2007 | Uchiyama et al. | |
| 2015/0192095 | A1 | 7/2015 | Lazich et al. | |
| 2016/0177880 | A1 | 6/2016 | Hartzler et al. | |

FOREIGN PATENT DOCUMENTS

| | | | |
|---|---|---|---|
| DE | 10 2004 025 254 | A1 | 12/2005 |
| JP | 9-317579 | A | 12/1997 |

* cited by examiner

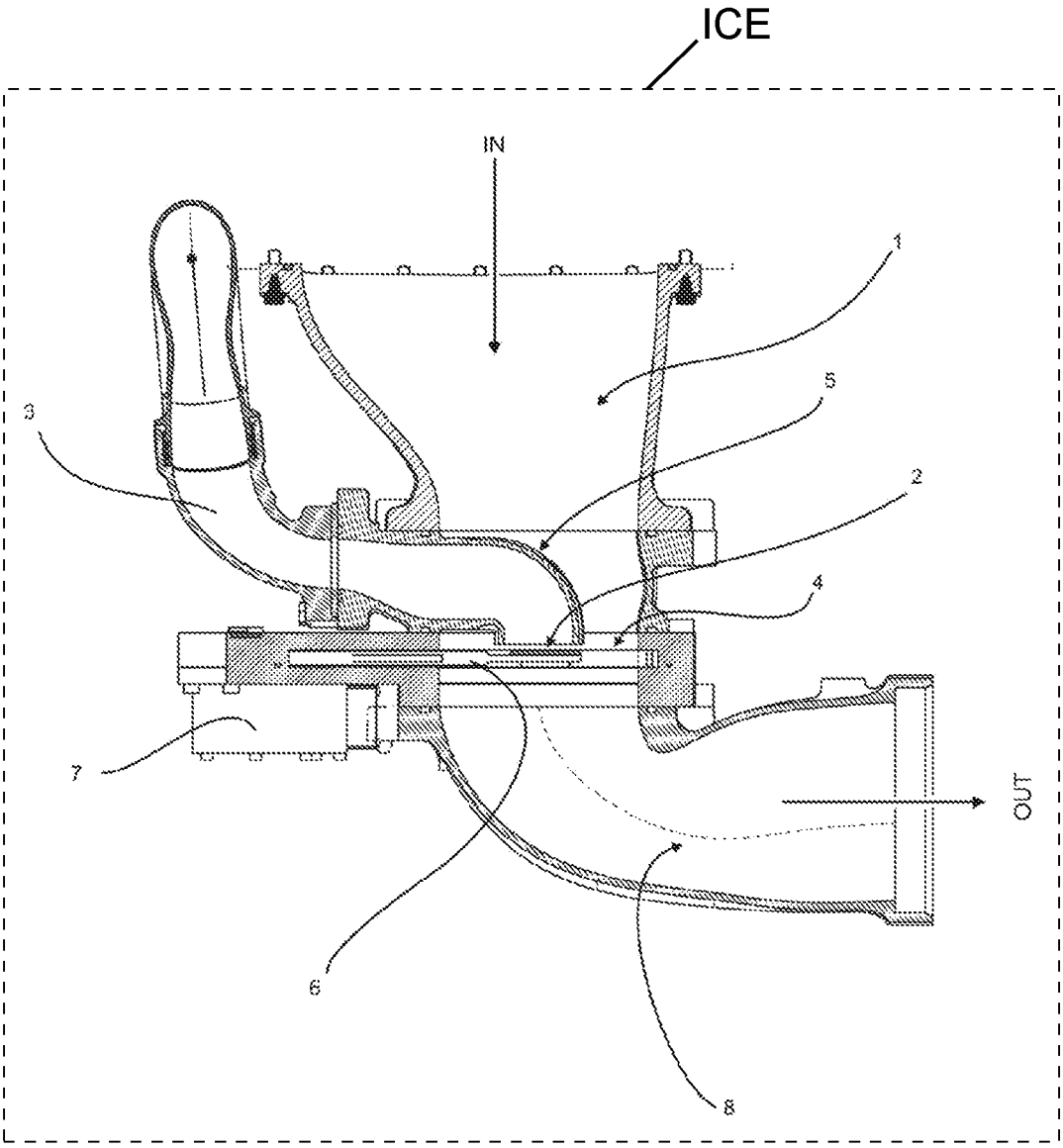
ICE
IN
1
5
3
2
4
7
OUT
6
8

FEEDING ARRANGEMENT FOR INTRODUCING RECIRCULATED EXHAUST GAS

CROSS REFERENCE TO RELATED APPLICATIONS

This is a continuation of PCT application No. PCT/EP2017/000295, entitled "FEEDING ARRANGEMENT FOR INTRODUCING RECIRCULATED EXHAUST GAS", filed Mar. 6, 2017, which is incorporated herein by reference.

BACKGROUND OF THE INVENTION

1. Field of the Invention

The present invention relates to a feeding arrangement for exhaust gas that is to be recirculated into the combustion air of internal combustion engines.

2. Description of the Related Art

In exhaust gas recirculation, part of the exhaust gas produced during combustion is supplied, as an inert gas, to the fresh air required for combustion of the fuel in order to thus reduce the oxygen content of the combustion air. Thus, combustion proceeds at low temperatures and the production of nitrogen oxides is reduced. JP 931 7579 A discloses various feeding arrangements for introducing, into the combustion air, the exhaust gas produced during combustion. These are multiple exhaust gas supply pipes which are inserted into the respective fresh air ducts of the individual cylinders. The described arrangements are supposed to allow the most homogeneous possible mixing of the exhaust gas with the fresh combustion air in order to thus be able to evenly reduce the temperature of combustion in all cylinders of the internal combustion engine. However, the introduction of the exhaust gas introduces soot particles, contained in the exhaust gas, into the fresh air duct, which soot particles can, when the internal combustion is operated for long periods, attach inter alia to the edges and shoulders of the fresh air duct. These deposits can be problematic in particular when the internal combustion engine is equipped with quick-closing valves which are provided for the purpose of rapidly shutting down the internal combustion engine in certain situations. They are located in the fresh air duct of the internal combustion engine and close this duct in order to immediately interrupt the fresh air supply necessary for combustion. Soot particle deposits in the region of the quick-closing valve may introduce the risk that, when the quick-closing valves are actuated, deposits and consequently inadequate sealing of the fresh air duct mean that the fresh air supply is not completely interrupted, or that, owing to particle deposits in the valve mechanism, triggering of the valves is prevented entirely, so that the internal combustion engine cannot be shut down in spite of the mechanism being triggered. Therefore, in order to ensure that the quick-closing valves always remain functional, such internal combustion engines are often subject to maintenance requirements which provide for regular manual triggering of the quick-closing valves in order to thus remove any deposits in the region of the valves. In practice, this has proven to be very onerous.

What is needed in the art is an internal combustion engine which minimizes some of the maintenance requirements.

SUMMARY OF THE INVENTION

The present invention provides a quick-closing valve arranged in the fresh air duct, upstream of a cylinder head of the internal combustion engine, in order to interrupt the fresh air supply. In that context, the outlet opening of the exhaust gas recirculation is arranged centrally in the fresh air duct and, in the flow direction of the fresh air, upstream of the quick-closing valve forming a minimum gap with the latter. In other words, in the closed state, the outlet opening of the exhaust gas recirculation and the valve plate of the quick-closing valve just do not touch. To bring about this arrangement, an elbow is used for the supply line of the exhaust gas stream.

The arrangement according to the present invention can have an advantage that mixing of the exhaust gas and fresh air streams takes place—as considered in the flow direction—only downstream of the quick-closing valve. In addition, the arrangement of the exhaust gas recirculation in the present invention effects a very homogeneous mixing of fresh air and recirculated exhaust gas. Starting from the outlet opening, the exhaust gas stream introduced into the fresh air stream spreads concentrically in the fresh air duct as a turbulent flow until it reaches the walls of the fresh air duct. In that context, the length of the path required to reach the walls of the fresh air duct is dependent on the Reynolds numbers of the two flows. The arrangement of the outlet opening of the exhaust gas supply pipe immediately upstream of the valve plate of the quick-closing valve ensures that no deposits of the soot particles contained in the exhaust gas form in the region of the valve mechanism. This guarantees that the valve mechanism is always ready to operate, thus dispensing with the maintenance requirement of regular manual actuation of the quick-closing valve.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein:

FIG. 1 shows a fresh air duct having a quick-closing valve and an exhaust gas supply pipe embodied as an elbow.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

FIG. 1 shows a fresh air duct 1 of an internal combustion engine ICE. The internal combustion engine ICE includes a cylinder head and a combustion chamber disposed downstream of the fresh air duct 1. As considered in the direction of the drawing, the fresh air required for combustion flows from top to bottom into the fresh air duct 1, denoted by IN. The fresh air duct 1 contains a quick-closing valve 4 which serves to interrupt the fresh air stream so as to permit rapid shut-down of the internal combustion engine ICE. The quick-closing valve 4 includes a quick-closing valve mechanism 7 and a valve plate 6. Closure of the quick-closing valve 4 is brought about as required by triggering of the quick-closing valve mechanism 7. Immediately upstream of the valve plate 6 of the quick-closing valve 4 is the outlet opening 2 of the exhaust gas recirculation 3, located centrally in the fresh air duct 1. The exhaust gas recirculation 3 may be in the form of an exhaust gas recirculation pipe 3. According to the present invention, immediately is to be understood as meaning that the outlet opening 2 of the exhaust gas recirculation 3 is arranged upstream of the valve plate 6 of the quick-closing valve 4 so as to form a minimal gap and thus, when the quick-closing valve 4 is closed, the outlet opening 2 and the valve plate 6 just do not touch. The central arrangement of the outlet opening 2 in the fresh air duct 1 may be necessary on one hand to achieve the most homogeneous possible mixing of the two gases, and on the other hand to maximize the distance that the soot particles contained in the exhaust gas have to travel before they meet the internal walls. In order to arrange the outlet point 2 centrally in the fresh air duct 1, the exhaust gas recirculation 3 is designed as an elbow 5.

The exhaust gas recirculation 3 serves to supply part of the exhaust gas produced during combustion to the fresh air. Proceeding from the outlet opening 2 of the exhaust gas recirculation 3, the exhaust gas flowing into the fresh air spreads concentrically under turbulent flow conditions. Thus, the soot particles contained in the exhaust gas first reach the internal walls of the fresh air duct 1 far downstream of the quick-closing valve 4, as considered in the direction of flow. This can effectively prevent the soot particles from depositing in the region of the quick-closing valve 4. The flow of the exhaust gas in the fresh air duct 1 is depicted in FIG. 1, proceeding from the outlet point 2 of the exhaust gas recirculation 3, as a dashed stream line 8 in order to represent the flow direction in the fresh air duct. Finally, once the exhaust gas and the fresh air have thoroughly mixed, the gas mixture leaves the fresh air duct 1 to the right, as considered in the direction of the drawing, toward the combustion chamber, denoted by OUT.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE SYMBOLS

1 Fresh air duct
2 Outlet opening
3 Exhaust gas recirculation
4 Quick-closing valve
5 Elbow
6 Valve plate
7 Quick-closing valve mechanism
8 Stream line

What is claimed is:

1. An internal combustion engine, comprising:
a cylinder head;
a fresh air duct configured for providing a fresh air supply to the internal combustion engine;
a quick-closing valve arranged in the fresh air duct, upstream of the cylinder head of the internal combustion engine, in order to interrupt the fresh air supply; and
an exhaust gas recirculation pipe having an outlet opening that is arranged centrally in the fresh air duct and, in a flow direction of the fresh air supply, upstream of the quick-closing valve forming a minimum gap between the outlet opening and the quick-closing valve.

2. The internal combustion engine of claim 1, wherein the exhaust gas recirculation pipe is in the form of an elbow that is used for introducing an exhaust gas into a combustion air.

3. The internal combustion engine of claim 1, wherein said minimum gap between said outlet opening and said quick-closing valve ensures that a deposit of soot particles, which is contained within an exhaust gas from the exhaust gas recirculation pipe, is not formed in a region of said quick-closing valve.

4. A feeding arrangement for introducing recirculated exhaust gas into a fresh air duct of an internal combustion engine, said feeding arrangement comprising:
a quick-closing valve configured for being arranged in the fresh air duct, upstream of a cylinder head of the internal combustion engine, in order to interrupt a fresh air supply; and
an exhaust gas recirculation pipe having an outlet opening that is configured for being arranged centrally in the fresh air duct and, in a flow direction of the fresh air supply, upstream of the quick-closing valve forming a minimum gap between the outlet opening and the quick-closing valve.

5. The feeding arrangement of claim 4, wherein the exhaust gas recirculation pipe is in the form of an elbow that is used for introducing an exhaust gas into a combustion air.

6. The feeding arrangement of claim 4, wherein said minimum gap between said outlet opening and said quick-closing valve ensures that a deposit of soot particles, which is contained within an exhaust gas from the exhaust gas recirculation pipe, is not formed in a region of said quick-closing valve.

* * * * *